US008281414B2

(12) United States Patent
Mickle

(10) Patent No.: US 8,281,414 B2
(45) **Date of Patent: *Oct. 9, 2012**

(54) GARMENT HAVING IMPROVED CONTACT AREAS

(75) Inventor: William K. Mickle, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 164 days.

This patent is subject to a terminal disclaimer.

(21) Appl. No.: 12/691,260

(22) Filed: Jan. 21, 2010

(65) Prior Publication Data

US 2010/0122403 A1 May 20, 2010

Related U.S. Application Data

(63) Continuation of application No. 11/144,750, filed on Jun. 6, 2005, now Pat. No. 7,748,056.

(51) Int. Cl.
*A41B 1/00* (2006.01)
*A41D 27/26* (2006.01)

(52) U.S. Cl. ..... 2/115; 2/267

(58) Field of Classification Search ..... 2/115, 69, 2/267, 268, 463, 464, 461
See application file for complete search history.

(56) References Cited

U.S. PATENT DOCUMENTS 714,079 A 11/1902 Whitley
907,050 A 12/1908 Hestness
930,741 A 8/1909 Dean
2,063,469 A * 12/1936 Smith ..... 2/94
2,302,368 A * 11/1942 Evans ..... 2/94
2,493,370 A * 1/1950 Smith ..... 2/94
2,632,894 A * 3/1953 Louis ..... 2/320
3,457,919 A * 7/1969 Harbard ..... 602/55
3,991,420 A 11/1976 Savarino
4,020,966 A 5/1977 Wszolek
4,158,242 A * 6/1979 Mitchell ..... 2/462
4,310,927 A 1/1982 DeBose
4,453,271 A 6/1984 Donzis
4,516,273 A * 5/1985 Gregory et al. ..... 2/462
4,517,893 A 5/1985 Wile et al.
4,623,558 A 11/1986 Lin
4,688,269 A 8/1987 Maeshima
4,728,538 A 3/1988 Kaspar et al.
4,783,853 A 11/1988 Zuber
4,810,559 A 3/1989 Fortier et al.
4,866,789 A 9/1989 Dorm
4,982,447 A 1/1991 Henson
4,989,265 A * 2/1991 Nipper et al. ..... 2/462
5,010,596 A * 4/1991 Brown et al. ..... 2/228
5,014,354 A 5/1991 Dumont
5,014,358 A * 5/1991 Matumori ..... 2/94
5,105,473 A 4/1992 Valtakari
(Continued)

*Primary Examiner* — Alissa L Hoey
(74) *Attorney, Agent, or Firm* — Maginot, Moore & Beck

(57) ABSTRACT

An athletic padding arrangement includes a garment made of a fabric and a plurality of resilient bulge shaped gripping members disposed on the fabric. The gripping members provide at least one high friction area on the garment, each of the gripping members is uniform in composition. At least one protective pad is releasably positioned on the garment with and underside of the protective pad in contact with the at least one high friction area. The gripping members exert a frictional force on the underside of the protective pad that is greater than the frictional force exerted by the fabric on the protective pad. The garment may be, for example, a shirt or a pant comprised of a compression fabric with moisture wicking properties.

17 Claims, 8 Drawing Sheets

U.S. PATENT DOCUMENTS 5,159,715 A 11/1992 Jurga et al.
5,168,576 A * 12/1992 Krent et al. ..... 2/456
5,188,034 A 2/1993 Iaccino et al.
5,210,877 A 5/1993 Newman
5,226,192 A 7/1993 Jones et al.
5,319,806 A 6/1994 Hermann et al.
5,325,537 A 7/1994 Marion
5,337,418 A 8/1994 Kato et al.
5,367,708 A 11/1994 Fujimoto
5,388,271 A 2/1995 Sessoms
5,418,980 A * 5/1995 Kelly ..... 2/170
5,500,956 A * 3/1996 Schulkin et al. ..... 2/161.1
5,561,857 A 10/1996 Hoshizaki et al.
5,625,900 A * 5/1997 Hayes ..... 2/161.8
D382,989 S * 9/1997 Simpson ..... D2/894
5,806,093 A 9/1998 Summers
5,822,794 A * 10/1998 Allred ..... 2/115
5,887,280 A * 3/1999 Waring ..... 2/69
5,948,707 A * 9/1999 Crawley et al. ..... 442/101
5,978,965 A * 11/1999 Summers ..... 2/69
6,029,273 A 2/2000 McCrane
6,032,300 A 3/2000 Bainbridge et al.
6,044,493 A 4/2000 Post
6,060,408 A 5/2000 Monica
6,070,267 A 6/2000 McKewin
6,093,468 A 7/2000 Toms et al.
6,135,852 A * 10/2000 Young ..... 450/86
6,138,281 A 10/2000 Chiaruttini
6,192,519 B1 * 2/2001 Coalter ..... 2/16
6,205,583 B1 3/2001 Beland
6,295,654 B1 10/2001 Farrell
6,427,248 B1 * 8/2002 Albert ..... 2/161.3
6,432,513 B1 8/2002 Thomsen et al.
6,453,477 B1 * 9/2002 Bainbridge et al. ..... 2/455
6,484,325 B1 11/2002 Lazarus et al.
6,485,446 B1 * 11/2002 Brother et al. ..... 602/20
6,510,560 B1 1/2003 Ugolnik
6,519,781 B1 2/2003 Berns
6,520,926 B2 * 2/2003 Hall ..... 602/64
6,530,090 B1 * 3/2003 Ambrose et al. ..... 2/59
6,553,579 B1 4/2003 Gillen et al.
6,589,891 B1 7/2003 Rast
6,708,342 B2 * 3/2004 Boersema ..... 2/69
6,745,403 B2 * 6/2004 Sajovic ..... 2/161.8
6,776,804 B2 8/2004 Crabtree et al.
6,780,460 B1 8/2004 Ou-Yang
D508,588 S * 8/2005 Groover ..... D29/100
6,934,969 B2 * 8/2005 Schorr et al. ..... 2/51
7,025,738 B2 * 4/2006 Hall ..... 602/75
7,155,746 B2 * 1/2007 Schorr et al. ..... 2/51
7,191,470 B2 * 3/2007 Benini ..... 2/69
D578,818 S * 10/2008 Margalit ..... D6/601
7,725,950 B2 * 6/2010 Hinebaugh ..... 2/16
7,730,553 B2 * 6/2010 Benini ..... 2/94
7,748,056 B2 * 7/2010 Mickle ..... 2/115
7,865,970 B2 * 1/2011 Giacheri ..... 2/22
7,874,021 B2 * 1/2011 Sunder et al. ..... 2/163
D632,056 S * 2/2011 Pijut ..... D2/717
7,900,269 B2 * 3/2011 Morrow et al. ..... 2/16
7,927,179 B2 * 4/2011 Kaye ..... 450/86
8,082,602 B2 * 12/2011 Crelinsten et al. ..... 2/455
2002/0055312 A1 5/2002 Beraznik
2002/0106953 A1 8/2002 Kim et al.
2002/0152531 A1 * 10/2002 Fusco et al. ..... 2/2.15
2003/0028947 A1 2/2003 Fee et al.
2004/0009302 A1 1/2004 Patterson
2004/0221371 A1 11/2004 Kato
2005/0081277 A1 4/2005 Matechen et al.
2005/0091725 A1 5/2005 Alley
2005/0114978 A1 6/2005 Benini
2005/0235392 A1 10/2005 Bay
2006/0005306 A1 * 1/2006 Call et al. ..... 2/463
2006/0053526 A1 3/2006 Beland et al.
2006/0068155 A1 3/2006 Rock et al.
2008/0256691 A1 * 10/2008 White et al. ..... 2/455
2008/0313793 A1 * 12/2008 Skottheim et al. ..... 2/461
2009/0100578 A1 * 4/2009 Coates ..... 2/455
2010/0000005 A1 * 1/2010 Dossman ..... 2/122
2010/0088795 A1 * 4/2010 Simione ..... 2/24
2010/0199406 A1 * 8/2010 Dua et al. ..... 2/115
2010/0229278 A1 * 9/2010 Bates ..... 2/115
2010/0242158 A1 * 9/2010 Blakely et al. ..... 2/461

* cited by examiner

GARMENT HAVING IMPROVED CONTACT AREAS

CROSS-REFERENCE TO RELATED APPLICATIONS

This application is a continuation of U.S. patent application Ser. No. 11/144,750, filed Jun. 6, 2006, now issued as U.S. Pat. No. 7,748,056, the content of which is incorporated herein by reference.

BACKGROUND

1. Field

The present disclosure relates to a garment having improved contact areas and, more specifically, to a garment which includes one or more relatively high-friction areas to resist sliding of, for example, protective pads worn over the garment.

2. Description of the Related Art

Many different athletics and activities require that a participant wear protective pads. For example, football, lacrosse and hockey players and participants in other contact sports, as well as baseball umpires, wear elaborate padding systems under their uniforms. Similarly, soldiers and other security personnel often wear body armor. Protective pads of all types are generally at least partially made of plastic for strength and lightness, but may be uncomfortable when worn next to a user's bare skin because of the plastic's stiffness and lack of breatheability. Also, ambient conditions may cause a user to desire an extra layer of clothing, which commonly must not alter the outside appearance of the user's uniform. For at least these reasons, it is common for users to wear clothing underneath protective pads.

Recently, many manufacturers have marketed specialty underclothing for use underneath protective pads. This underclothing is often made of a synthetic material designed to reduce chafing from the plastic of the protective pads and to quickly wick away perspiration from the user's skin to keep the user dry. However, such synthetic material often has a smooth or even somewhat slippery texture and hence a very low coefficient of friction when contacting protective pads. Consequently, the protective pads may shift or slide from a desired position during rigorous use (such as during a football game) and therefore might fail to protect the user's body.

An example of a system for securing apparel to protective equipment is disclosed in U.S. Application Publication No. 2003/0115663, to Turner et al. (hereafter referenced as '663). Unlike the present disclosure, the '663 system is intended to prevent relative movement between outer apparel and underlying protective pads. However, even if the '663 apparel were located between the user's body and outer protective pads, several undesirable effects would occur.

First, the '633 system uses patches of hooked material (e.g., hook-side VELCRO®) to secure the protective pads, with the hook-side patch attached to the protective pad. The '633 hook-side patch of the protective pads mates with loops formed on the apparel. Therefore, protective pads must be adapted to work with the '633 system, and a user accordingly must take the time and effort to prepare equipment for use with the '633 system before achieving the non-slip benefits of the system. Also, if the '633 system were adapted as suggested above, the hooks of the hook-side patch might protrude through the material of the user's undergarment and scratch the user or opponent.

Second, while apparel, such as a football jersey, is generally relatively inexpensive and personal to one user, protective pads are much more expensive and might be shared by different users or borrowed for a game or for a season from a common pool, such as from a sports rental office. Therefore, the user is inconvenienced by having to remove the '633 hook-side patch from the protective pads to return the borrowed pads to their original condition if such is a requirement of the loan. Moreover, the '633 hook-side patches may be attached with single-use adhesive, which would require the user to purchase additional '633 hook-side patches or use inconvenient and messy replacement glues when using the hook-side patches of the '633 system with multiple sets of protective pads.

Finally, the '633 hook-side patches are made of a continuous piece of high-density material. Even if the protective pads themselves allowed for ventilation of the user's skin, such a continuous covering would instead promote and even trap perspiration next to the user's skin, thus causing user discomfort contrary to the intent of the perspiration-wicking undergarment.

SUMMARY

The present disclosure is directed to a garment including a fabric and numerous bulge shaped gripping members located on at least a portion of the fabric. The gripping members are a material that exerts a greater frictional force on an object in contact with the gripping members than the frictional force exerted by the fabric on the object. Preferably, the gripping members are oval-shaped discrete elements of material having the greater frictional force, and the discrete elements are each attached to the fabric which may itself be a shirt. The gripping members are preferably grouped into two areas on the chest area of the shirt, and may also be located on the sleeve and back areas of the shirt.

The present disclosure is also preferably directed to an athletic garment for use in combination with protective padding. The athletic garment includes a fabric and numerous bulge shaped gripping members on the fabric at a location in contact with at least some of the protective padding. The gripping members comprise discrete elements of a material that exerts a frictional force on the padding that is greater than the frictional force exerted by the fabric on the padding. Preferably, the athletic garment is a shirt and the protective padding is football shoulder pads. Preferably, the gripping members are located on the chest, arm and/or back areas of the shirt, and are oval shaped.

Features of the arrangement disclosed herein include an aesthetically pleasing and functional garment to be used by athletes or a user that desires to reduce sliding between the garment and a piece of equipment or clothing. The arrangement also provides breathability which adds a new level of comfort and utility not found in the prior art. These and other features may best be understood with reference to the accompanying drawings and the detailed description of exemplary embodiments of the invention.

DETAILED DESCRIPTION OF EXEMPLARY, NON-LIMITING EMBODIMENTS OF THE INVENTION

The present disclosure is directed to a garment which resists sliding of, for example, protective pads worn over the garment during use. The following description refers to the use of football pads in combination with the garment as an example of one application of the garment having improved contact areas. However, it will be understood that the disclosed embodiments may be applied to any other desirable application such as, but not limited to, hockey, lacrosse, body armor, and the like.

Figure 1A:
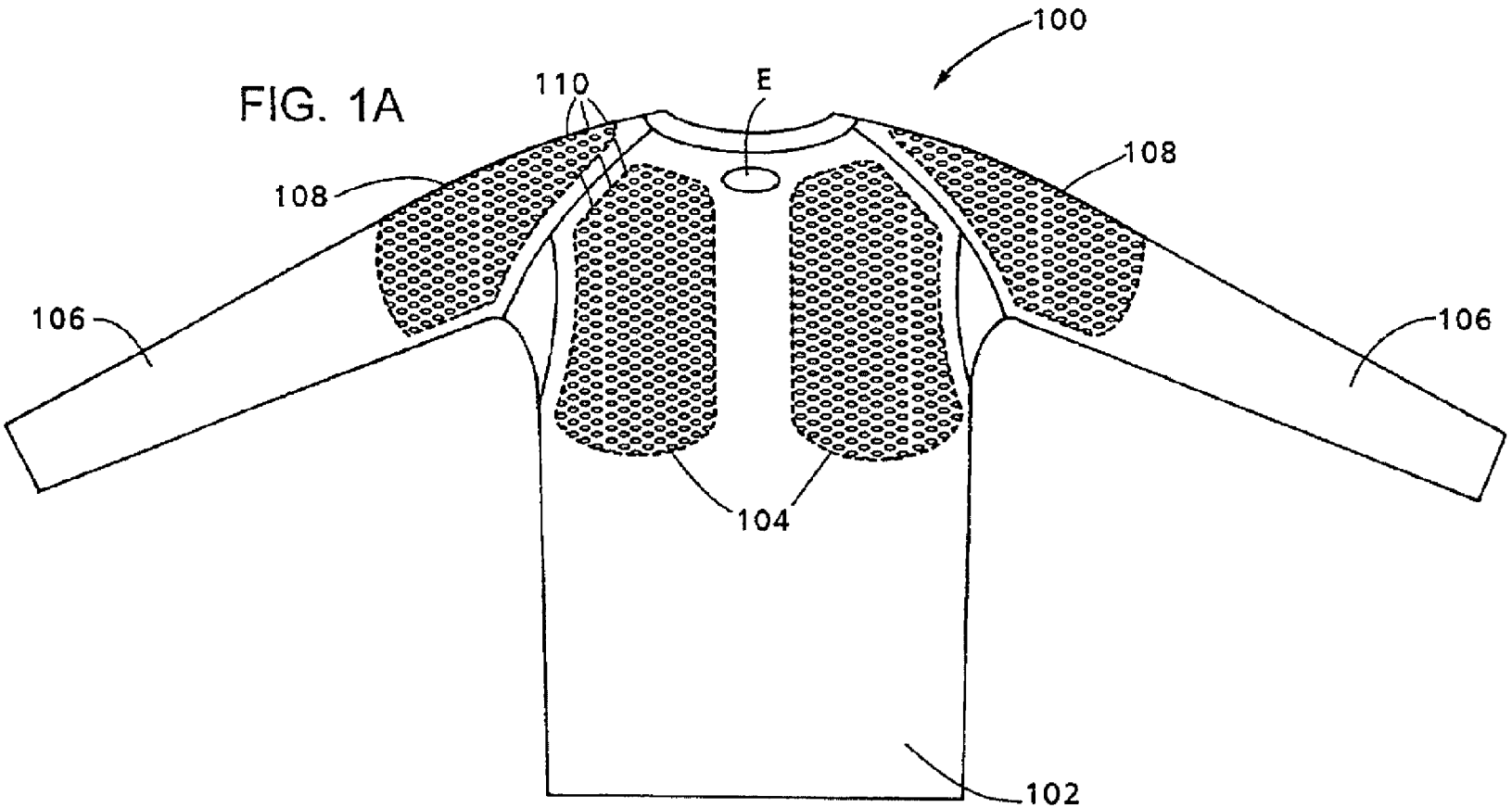
FIGS. 1A-1B illustrate a garment according to an exemplary, non-limiting embodiment of the present invention.

FIG. 1A depicts a garment 100 according to an exemplary embodiment of the present invention. The garment 100 includes a front portion 102, made of a first material, and at least one high-friction area 104 (denoted by a dashed line) disposed on front portion 102. The material may be a polyester/elastane fabric with moisture-wicking properties. For example, the fabric may comprise 5 oz/yd.sup.2 micro-denier polyester/elastane warp knit tricot fabric that will wick moisture from the body and include 76% 40 denier dull polyester and 24% 55 denier spandex knit. The high elastane content allows for proper stretch and support. The fabric may be a tricot construction at a 60" width. The mean warp stretch may be 187% at 10 lbs of load, and the mean width stretch may be 90% at 10 lbs of load. This fabric also may have a wicking finish applied to it. Such a fabric is available from UNDER ARMOUR®. Although this material is given as an example, it will be appreciated that other materials known in the art can be used.

It will be appreciated that other materials may also be used such as, but not limited to, microfibers, including elastane, nylon, polyester, blends thereof and the like. As shown in FIG. 1A, high-friction area 104 may comprise two sections, one section being positioned in a left breast area and the other section being positioned in a right breast area. High-friction areas 104 may be disposed on front portion 102 such that an emblem (E) can be positioned therebetween.

In the embodiment shown in FIG. 1A, front portion 102 has high friction areas 104 located in the upper torso area. Second portions 106, shown here as left and right arm portions, are attached to front portion 102. Front portion 102 may be separated from second portions 106 by seams 112. In this case, high-friction areas 104 on front portion 102 are first high-friction areas 104. Second high-friction areas 108 (denoted by a dashed line) may be disposed on second portions 106. The dashed lines are provided in the Figures to more clearly show high-friction areas 104, 108 but no visual delineation of high-friction areas 104, 108 is required on garment 100 itself. Conversely, high-friction areas 104, 108 may optionally be set apart from the rest of garment 100 by a different color or material or the like, whether for functional or aesthetic reasons.

High-friction areas 104, 108 are each defined by a plurality of gripping members or islands 110 providing channels therebetween. Each of high-friction areas 104, 108 is defined by multiple gripping members 110, arranged in a suitable fashion. Gripping members 110 are each made of a flexible second material, such as, but not limited to, a tackifying ink or the like. The tackifying ink may be applied to garment 100 using a screen-printing process. In any event, the tackiness of gripping members 110 is high enough such that the padding worn over garment 100 does not slide off of the desired areas of contact with garment 100 and thus create an uncomfortable situation for the user.

The tackifying ink may be a PVC (polyvinyl chloride) based printing ink, known as plastisol. An example of a plastisol ink is Ultra Gel, which is a press-ready plastisol for screen printing on fabrics available from Rutland, Inc. of Pineville, N.C. Plastisol inks usually also contain plasticizers to aid in the screen printing process. Plasticizers are present because PVC alone is a very rigid plastic and has to be softened or plasticized to give it the necessary degree of flexibility.

U.S. Pat. No. 4,517,893 (Wile et al.), the disclosure of which is incorporated herein by reference, discloses the use of plastisols in silk screen printing to form a tough, rubber-like film that can stretch with the fabric without losing its adhesion and has the further desirable quality of being able to withstand repeated washing cycles. The use of plastisols for screen printing is also disclosed in U.S. Pat. No. 6,780,460, the disclosure of which is also incorporated herein by reference.

Figure 1B:
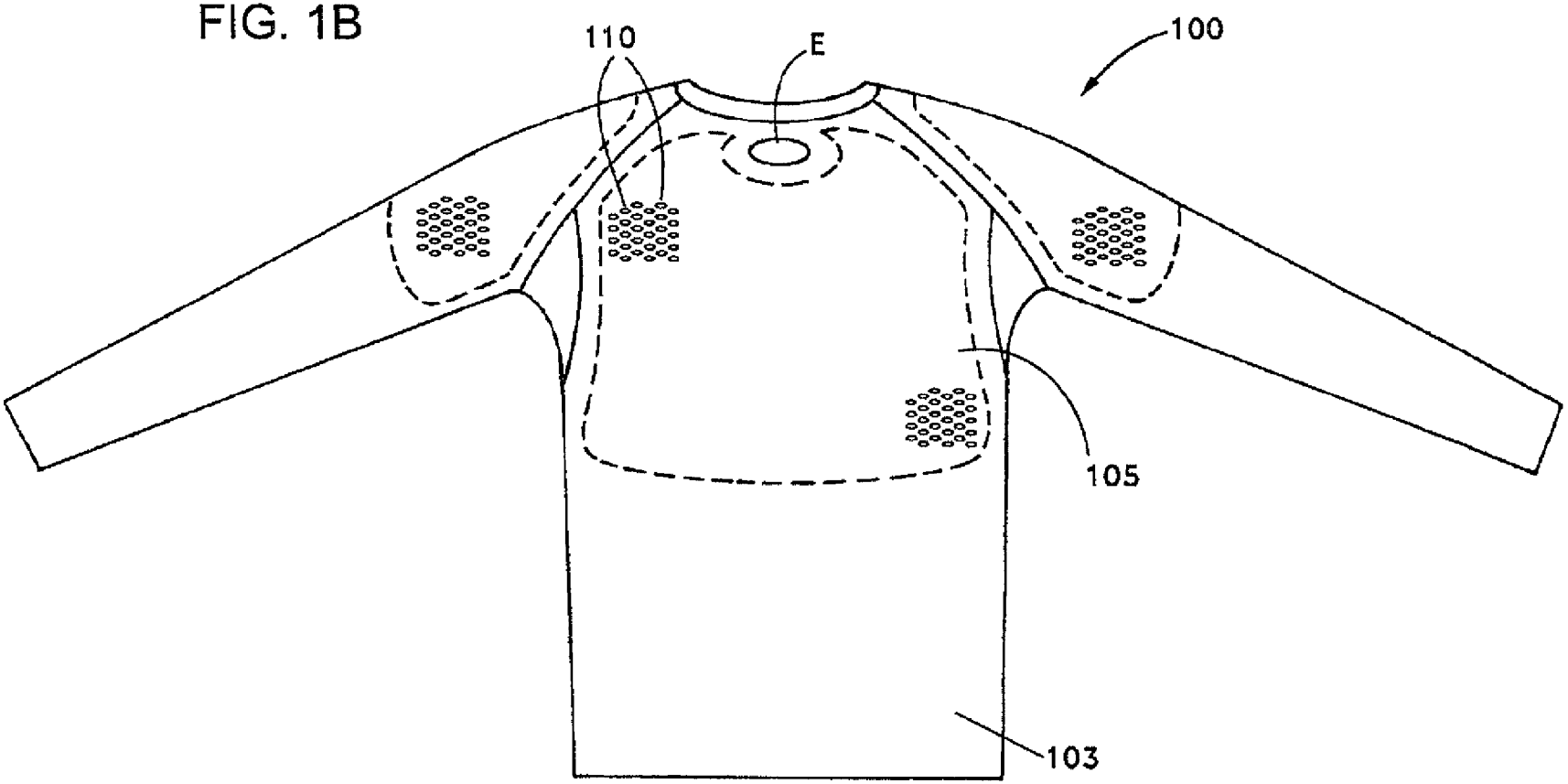

The garment 100 is well suited to be worn with compression type clothing where an additional garment or shirt is disposed over the padding or where the padding is secured to the user with straps, to contain the underlying elements in a snug, compressed manner on a user's body. FIG. 1B depicts a back portion 103 of garment 100 that is made of the first material and has a friction area 105 (denoted by a dashed line) disposed on back portion 103. Although gripping members 110 populate areas 105 and 108 entirely, only portions of the gripping members 110 are shown in the back view. It will be understood that high friction area 105 could be arranged as two high friction areas such as two high friction areas 104. High-friction area 105 includes a plurality of gripping members 110 that extend across back portion 103 in a horizontal and vertical direction. Gripping members 110 on back portion 103 preferably form one group of equally spaced gripping members 110. However, it will be appreciated that the grouping or spacing may be altered to conform to the particular needs of a user. Additionally, an emblem (E) may be positioned among gripping members 110.

Figure 2A:
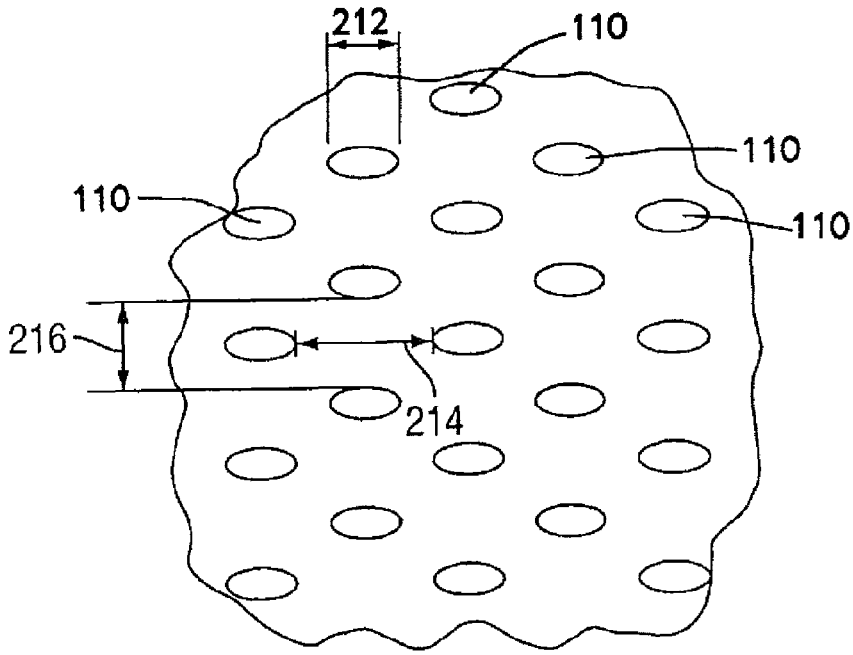
FIGS. 2A-2C illustrate portions of a high-friction area according to an exemplary, non-limiting embodiment of the present invention.
Figure 2B:
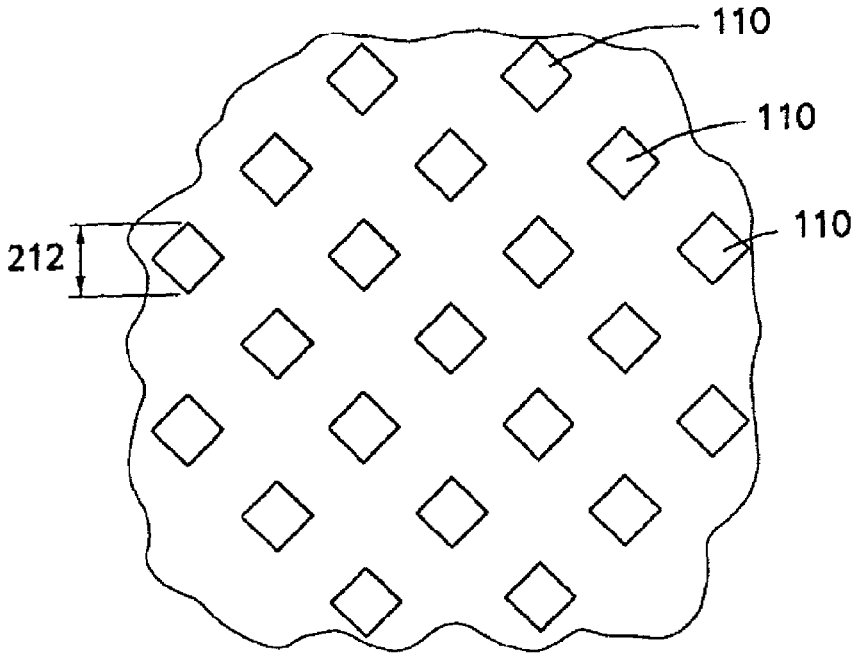
Figure 2C:
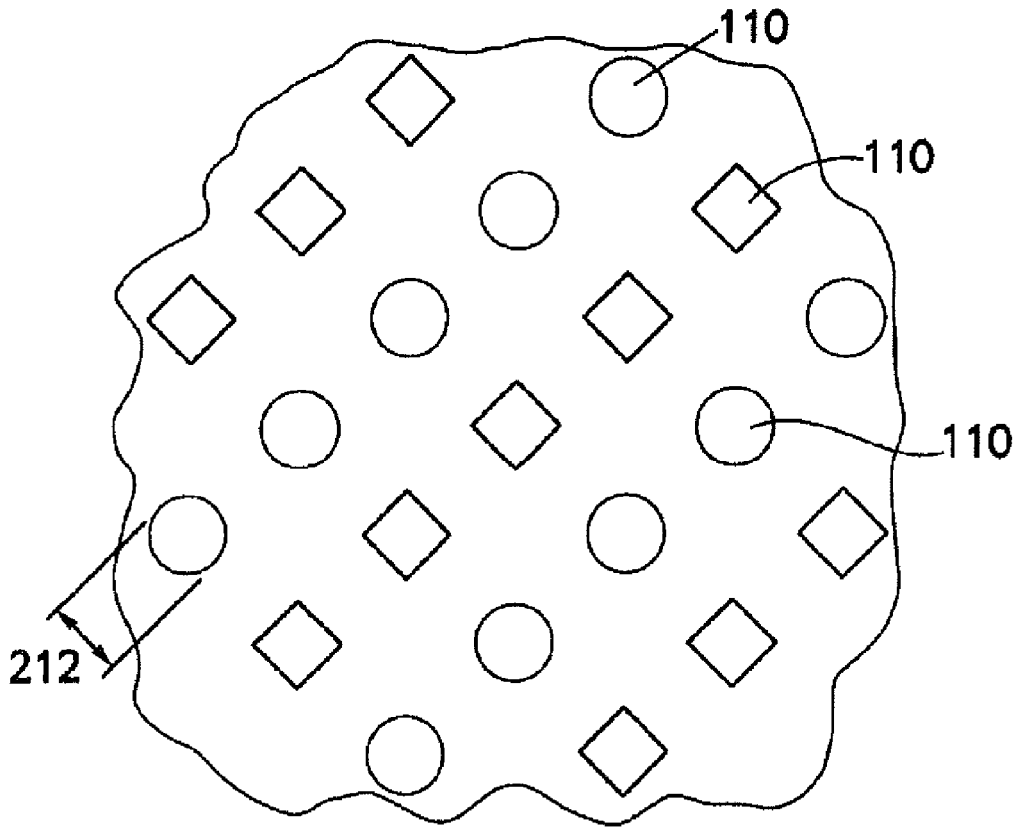

Gripping members 110 may be of any suitable size and have a bulged shape. For example, as shown in FIG. 2A, each gripping member 110 may be rounded or substantially oval-shaped. FIGS. 2B and 2C illustrate additional examples of other non-limiting embodiments of gripping members 110 of the present invention including rectangular-shaped gripping members 110 or a combination of rectangular- and round-shaped gripping members 110. Preferably, each gripping member 110 is oval-shaped, having a width diameter 212 of about 5 mm to about 10 mm, more preferably, about 6 mm to about 8 mm, and a height diameter of about 2 mm to about 6 mm, more preferably, about 3 mm to about 4 mm. In the event that gripping members 110 are square-shaped, gripping members 110 may be about 5 mm to about 10 mm, by about 5 mm to about 10 mm, more preferably, about 6 mm to about 8 mm, by about 6 mm to about 8 mm. In the event that gripping members 110 are circle-shaped, the circles may have a diameter of about 5 mm to about 10 mm, more preferably about 6 mm to about 8 mm. Preferably, gripping members 110 have a flat top surface for gripping the protective pads, etc. Gripping member 110 preferably has a height above the surface of garment 100 that is about 0.5 mm to about 1.0 mm, more preferably about 0.6 mm to about 0.7 mm. Gripping members 110 may be of differing gripping member sizes and shapes varying within the gripping member sizes and shapes discussed above, or may all be the same gripping member size and shape. The gripping member sizes and shapes may optionally be chosen responsive to the location or position of each gripping member 110 on the garment. The size, shape, and/or position of gripping members 110 may be determined for optimum functional and/or aesthetic results in a given application.

In the exemplary embodiment of FIG. 2A, each gripping member 110 is preferably separated from adjacent gripping members in the horizontal direction 214 by a distance of about 5 mm to about 10 mm, more preferably about 7 mm to about 9 mm. Each gripping member 110 is preferably separated from adjacent gripping members in the vertical direction 216 by a distance of about 10 mm to about 20 mm, more preferably about 11 mm to about 13 mm. High-friction areas, such as 104, 108 contain sufficient space not covered by gripping members 110 to allow breatheability through garment 100 and increased comfort for the user.

Gripping members 110 are positioned on an outside of the garment and are intended to exert a frictional force on an underside of protective pads, for example, worn over the garment, so as to reduce slippage between the garment and the protective pads. Gripping members 110 may also be positioned on an inside of the garment to exert a frictional force to protective pads worn under the garment, so as to reduce slippage between the garment and the protective pads. It will also be appreciated that gripping members 110 can be positioned on an inside of garment 100 to exert a frictional force directly to a user or directly to another layer of clothing, instead of having gripping members 110 contact the pads. The use of a plurality of gripping members 110 in a localized area produces multiple points where stress between gripping members 110 and the protective pads is increased.

Figure 3:
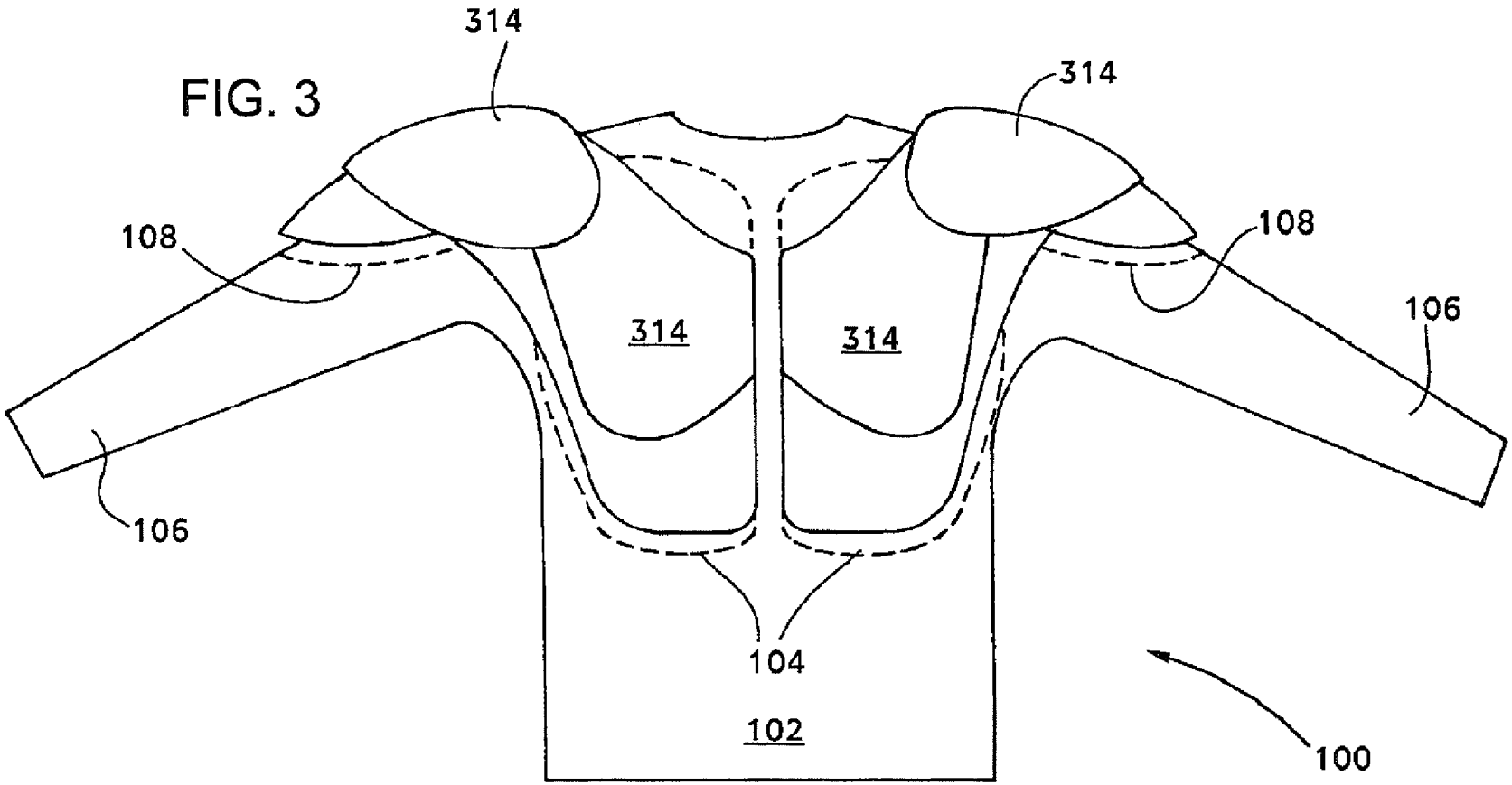
FIG. 3 illustrates protective pads worn with a garment according to an exemplary, non-limiting embodiment of the present invention.

FIG. 3 depicts a portion of a set of protective pads 314, as commonly used by football players, worn over a garment 100 according to one non-limiting exemplary embodiment of the present invention. Protective pads 314 generally are of somewhat standard sizes and shapes, and high-friction areas 104, 108 may be designed to have a substantially similar outline to an outline of the corresponding portion of protective pad 314 in contact with garment 100 and worn to protect that area of the user's body. High-friction areas 104, 108 may be slightly larger than the portion of protective pads 314 in contact therewith, as shown in FIG. 3, to allow for slight variances in user-preferred positioning of the protective pads 314.

Garment 100 may be donned by the user as an undergarment, and then the protective pads 314 may be attached to the user's body atop garment 100 in a known manner, such as via a harness, or other strapping/positioning means. The user may optimally wear a jersey or other uniform component atop protective pads 314. As the user participates in athletic activities, protective pads 314 will tend to shift position on the user's body because of the user's own movements or outside forces acting on the user. Without use of the high friction areas, such sliding or shifting of protective pads 314 could result in discomfort to the user if the movement of protective pads 314 chafes the user's skin and could result in a failure to provide cushioning to the desired portions of the user's body.

In order to reduce or prevent sliding of protective pads 314, high-friction areas 104, 108 exert a frictional force on protective pads 314 relative to garment 100 and thereby also tend to keep protective pads 314 substantially in their original position on the user's body. Such forces counteract against outside forces that would otherwise cause protective pads 314 to slide across the skin or non-gripping undergarment of the user. Depending upon the outside force and/or the relative materials of high-friction areas 104, 108 and protective pads 314, some sliding or shifting of the protective pads 314 may still occur, but the frictional force produced by gripping members 110 is intended to mitigate such a sliding effect.

Figure 4A:
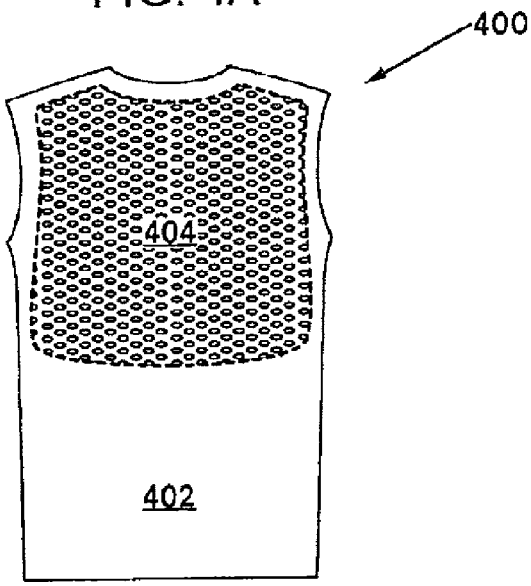
FIGS. 4A-4C illustrate additional garments according to exemplary, non-limiting embodiments of the present invention.
Figure 4B:
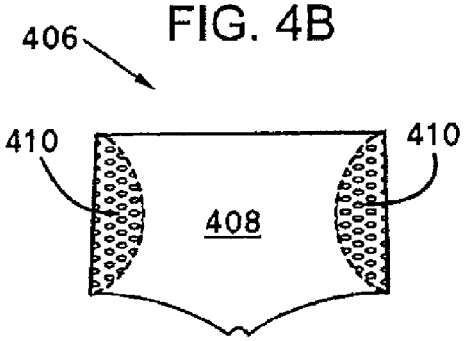
Figure 4C:
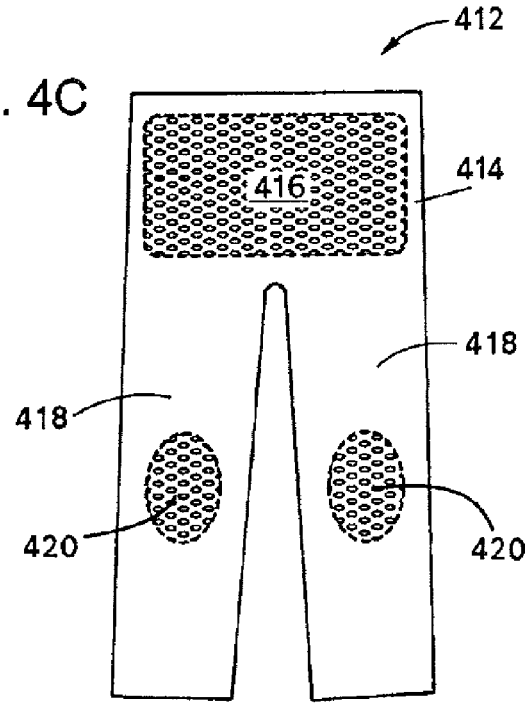

Various garments, non-limiting examples of which are shown in FIGS. 4A-4C, may include gripping members 110 in accordance with exemplary embodiments of the present invention. FIG. 4A depicts a sleeveless singlet garment 400 having a torso portion 402 with a high-friction area 404 disposed thereon. FIG. 4B depicts a brief-type garment 406 having torso portion 408 with high-friction areas 410 disposed on the sides thereof. FIG. 4C depicts a pant garment 412 having torso portion 414 with a high-friction area 416 disposed thereon, and having attached thereto second portions 418, shown as right and left leg portions, having high-friction areas 420 disposed thereon. High friction areas 404, 410, 416 and 420 include gripping members 110 having any of the above-noted shapes and dimensions.

Figure 5A:
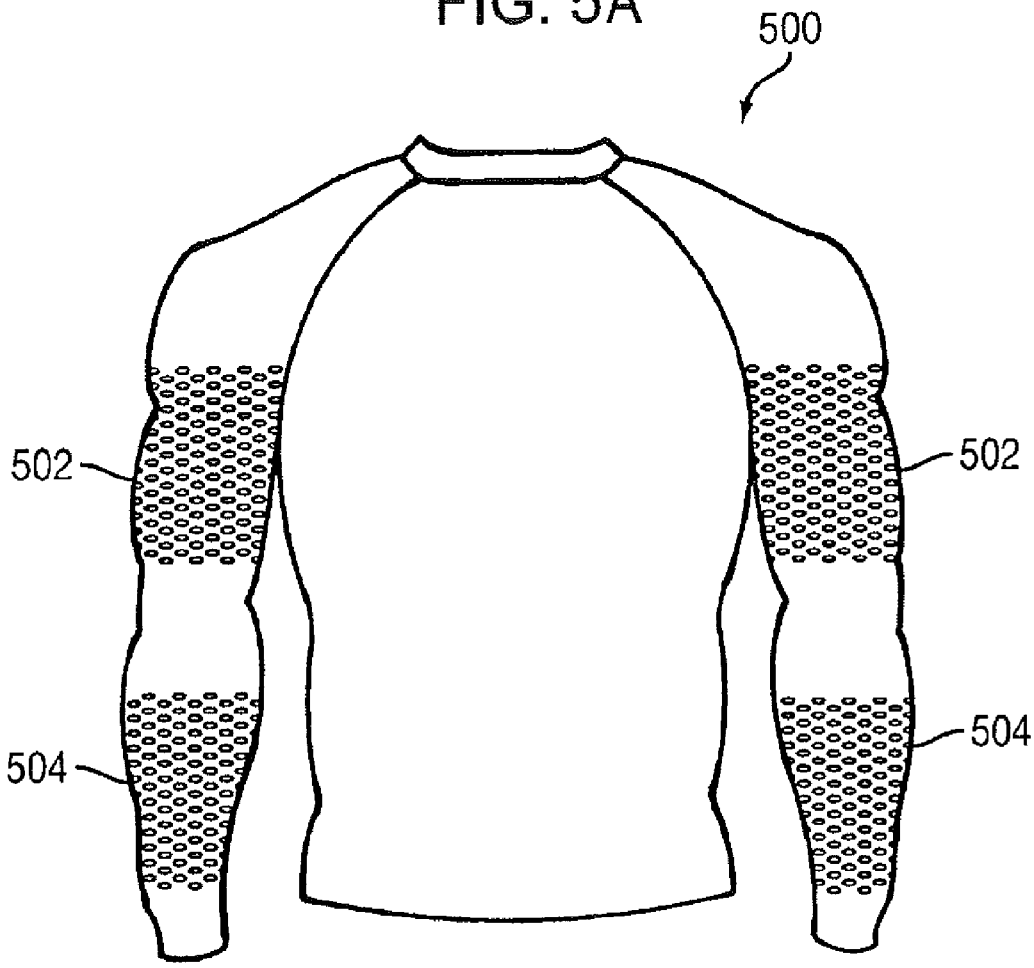
FIGS. 5A-5B illustrate a further garment according to an exemplary, non-limiting embodiment of the present invention.
Figure 5B:
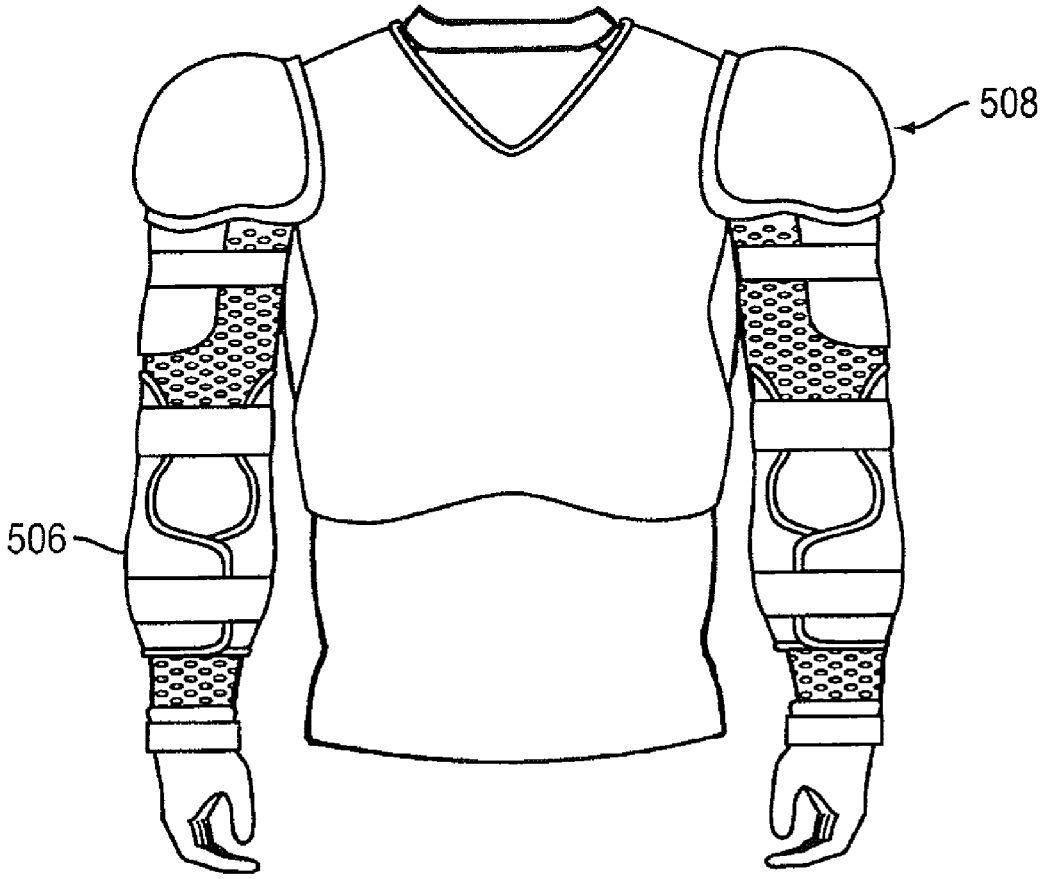

FIGS. 5A and 5B illustrate an exemplary embodiment of a garment 500 that may be used beneath pads, such as those worn by a hockey player. High friction areas 502 are provided in upper arm sleeve areas of garment 500 and additional high friction areas 504 are provided in lower arm sleeve areas of garment 500. High friction areas 502 reduce slipping between garment 500 and pads 508 having portions extended along the user's biceps (see FIG. 5B). High friction areas 504 reduce slipping between garment 500 and pads 506 disposed in the lower arm area. The increase in friction between garment 500 and pads 506 and 508 may be further assisted by straps that compress the padded areas to the user's arms. As shown in FIGS. 5A and 5B, the plurality of gripping members are arranged into a plurality of rows in the horizontal direction and columns in the vertical direction on the upper arm sleeve area at the high friction area 502 and the lower arm sleeve area at the high friction area 504. As shown in FIGS. 5A and 5B, outer portions of the fabric of the garment 500 between the plurality of gripping members form interconnected channels extending from side to side and top to bottom of the high friction areas 502 and 504 beneath the protective arm padding 506. An elbow area of the garment is disposed between the friction areas 502 and 504. In the embodiment of FIGS. 5A and 5B, no bulge shaped gripping members are provided in the elbow areas of the garment between the upper arm sleeve areas and the lower arm sleeve areas.

In an exemplary embodiment, high friction area 502 has a length 510 of about 15 cm to about 25 cm, more preferably, about 17 cm to about 23 cm. High friction area 504 has a length 512 of about 11 cm to about 20 cm, more preferably, about 14 cm to about 17 cm. High friction area 504 may start about 7 cm to about 15 cm from a bottom hem 514 of the sleeve, more preferably, about 9 cm to about 12 cm from the bottom hem. High friction area 502 may start about 1 cm to about 5 cm from a raglan under arm seam of the sleeve, more preferably, about 2 cm to about 4 cm from the under arm seam. It is also noted that the sleeves can have a seam in the lengthwise direction, and the high friction areas 502 and 504 may be parted around the lengthwise seam so that individual gripping members 110 are spaced about 1 cm to about 4 cm from the lengthwise seam, more preferably, about 2 cm to about 3 cm from the seam. As will be appreciated, high friction areas 502 and 504 include gripping members 110 having any of the above-noted shapes and dimensions. These dimensions and positions can be varied to correspond with other types of protective wear, such as pads worn during lacrosse and the like. The garment 500 is accordingly well suited for use with padding that is strapped on a user's body to assist in maintaining the padding in a desired position.

While exemplary aspects of the present invention have been particularly shown and described with reference to exemplary, non-limiting embodiments above, it will be understood by those skilled in the art that various additional embodiments may be contemplated without departing from the spirit and scope of the present invention. For example, the garment might be only one of several layers of underclothing worn by the user; the garment could be worn at times without overlying protective pads; the high-friction areas could cover substantially the entire garment; or the size, shape, and/or positioning of the gripping members could be assigned and/or marketed for use in a specific activity. However, a device or method incorporating such an embodiment should be understood to fall within the scope of the present invention as determined based upon the claims below and any equivalents thereof.

What is claimed is:

1. An athletic padding arrangement configured to be worn by a human, the athletic padding arrangement comprising:

a shirt without an attached pant, the shirt including a compression fabric and a plurality of resilient bulge shaped gripping members disposed on the compression fabric, the gripping members providing at least one high friction area on the shirt, including a high friction area on a front shoulder portion and a high friction area on a rear shoulder portion, each of the gripping members uniform in composition; and at least one protective shoulder pad releasably positioned on the shirt with an underside of the protective pad in contact with the high friction area on the front shoulder portion and the high friction area on the rear shoulder portion, wherein the gripping members exert a frictional force on the underside of the protective pad that is greater than the frictional force exerted by the fabric on the protective pad.

2. The athletic padding arrangement of claim 1 wherein the gripping members are comprised of a tackifying ink.

3. The athletic padding arrangement of claim 1 wherein the fabric is comprised of a material with moisture wicking properties.

4. The athletic padding arrangement of claim 1 wherein each of the gripping members is from 5 mm to 10 mm in diameter.

5. The athletic padding arrangement of claim 1 wherein each of the gripping members has a height above an outer surface of the garment of 0.5 mm to 1.0 mm.

6. The athletic padding arrangement of claim 1 wherein an outer surface of the fabric is exposed between each gripping member and wherein each gripping member is separated from adjacent gripping members by 5 mm to 20 mm.

7. The athletic padding arrangement of claim 1 wherein the garment is a shirt.

8. The athletic padding arrangement of claim 1 wherein the at least one protective pad includes football shoulder pads.

9. An athletic garment arrangement for a human body, the athletic garment arrangement comprising:

a protective padding member configured to be worn on an upper portion of the human body, the protective padding member including a padded portion and a rigid portion; and a shirt with a front shoulder portion and a rear shoulder portion but without an attached pant, the shirt positioned between the protective padding member and the upper portion of the human body, the shirt comprising:

a fabric, and gripping members fixed on the fabric on the front shoulder portion and the rear shoulder portion, the gripping members releasably engaging the protective padding member, the gripping members comprised of a material exerting a frictional force on the protective padding member that is greater than the frictional force exerted by the fabric on the protective padding member.

10. The athletic garment arrangement as claimed in claim 9, wherein the garment is a long sleeved shirt.

11. The athletic garment arrangement as claimed in claim 10, wherein the protective padding member is football shoulder pads, and the gripping members are disposed at locations on the shirt in contact with the football shoulder pads.

12. The athletic garment arrangement as claimed in claim 11, wherein the gripping members are disposed on arm areas of the athletic shirt in contact with the football shoulder pads.

13. The athletic garment arrangement as claimed in claim 9, wherein the gripping members are comprised of plastisol.

14. The athletic garment arrangement of claim 9 wherein the gripping members are positioned on an outer surface of the fabric and wherein the gripping members contact an inner surface of the protective padding member.

15. An athletic garment arrangement for a human body, the athletic garment arrangement comprising:

a shirt without an attached pant, the shirt comprising a fabric, the shirt including a front shoulder portion and a rear shoulder portion;

protective padding releasably positioned on the shirt and at least partially covering the front shoulder portion and rear shoulder portion; and a plurality of gripping members disposed on the fabric at the front shoulder portion and the rear shoulder portion such that the plurality of gripping members are in releasable contact with at least a portion of the protective padding, the gripping members comprising discrete elements of a material exerting a frictional force on an underside of the protective padding that is greater than the frictional force exerted by the fabric on the protective padding.

16. The athletic garment of claim 15 wherein the garment is a shirt and the protective padding includes football shoulder pads.

17. The athletic garment as claimed in claim 16, wherein the plurality of gripping members are disposed on at least one of the chest, arm and back areas of the garment in contact with the football shoulder pads.

* * * * *